United States Patent [19]

Amemori et al.

[11] Patent Number: 4,538,561

[45] Date of Patent: Sep. 3, 1985

[54] VALVE ARM CHAMBER APPARATUS FOR DIESEL ENGINE

[75] Inventors: Koichi Amemori; Toshihiko Kawabe, both of Takatsuki; Manabu Miyazaki, Ibaraki, all of Japan

[73] Assignee: Yanmar Diesel Engine Co., Ltd., Osaka, Japan

[21] Appl. No.: 553,897

[22] Filed: Nov. 21, 1983

[30] Foreign Application Priority Data

| | | | |
|---|---|---|---|
| Jun. 20, 1983 | [JP] | Japan | 58-109300 |
| Jun. 20, 1983 | [JP] | Japan | 58-109301 |
| Jun. 21, 1983 | [JP] | Japan | 58-94172[U] |
| Jun. 29, 1983 | [JP] | Japan | 58-115790 |
| Jun. 29, 1983 | [JP] | Japan | 58-115791 |

[51] Int. Cl.[3] ..... F01L 1/46

[52] U.S. Cl. ..... 123/90.44; 123/193 H; 123/508

[58] Field of Search ..... 123/90.37, 90.38, 90.27, 123/90.44, 90.6, 372, 468, 469, 470, 471, 90.39, 193 H, 508

[56] References Cited

U.S. PATENT DOCUMENTS

| | | | |
|---|---|---|---|
| 1,394,953 | 10/1921 | Tacchella | 123/372 |
| 2,845,915 | 8/1958 | Frick | 123/372 |
| 3,672,338 | 6/1972 | Yamanouchi | 123/90.38 X |
| 4,267,811 | 5/1981 | Springer | 123/90.27 X |
| 4,307,693 | 12/1981 | Glöckler et al. | 123/470 |
| 4,448,166 | 5/1984 | Amemori et al. | 123/90.27 X |

FOREIGN PATENT DOCUMENTS

| | | | |
|---|---|---|---|
| 2060774 | 5/1981 | United Kingdom | 123/470 |

*Primary Examiner*—William R. Cline
*Assistant Examiner*—Peggy A. Neils
*Attorney, Agent, or Firm*—Armstrong, Nikaido, Marmelstein & Kubovcik

[57] ABSTRACT

A valve arm chamber apparatus for a diesel engine having, on a cam shaft mounted above intake and exhaust valves thereof, fuel cams for rocking fuel valve arms for driving unit injectors mounted in a cylinder head and intake and exhaust valve cams for rocking intake and exhaust valve arms for opening and closing the intake and exhaust valves, which apparatus comprises a valve arm chamber member which supports the cam shaft, a fuel valve arm shaft for supporting the fuel valve arms, and intake and exhaust valve arm shafts for supporting the intake and exhaust valve arms.

6 Claims, 5 Drawing Figures

VALVE ARM CHAMBER APPARATUS FOR DIESEL ENGINE

BACKGROUND OF THE INVENTION

The present invention relates to a valve arm chamber apparatus for a diesel engine having unit injectors mounted on the cylinder head thereof. More particularly, the invention is concerned with an improvement in the supporting means for supporting shafts of a diesel engine of the type described above such as a cam shaft, fuel valve arm shaft for supporting fuel valve arms and an exhaust valve arm shaft for supporting exhaust valve arms.

Generally, in an OHC engine of the type having valve arms, it is necessary to maintain shoes or rollers on the intake and exhaust valve arms in direct and accurate contact with the cam surfaces. The degree of parallelism between the cam shaft and the intake and exhaust valve arm shafts, therefore, is the most significant factor. Namely, if the required degree of parallelism is failed, the shoes will contact the cam surface at an inclination to seriously impair the durability of the shoe and make the operation of the intake and exhaust valves incorrect.

On the other hand, in diesel engines having unit injectors, it is an ordinary measure to dispose the fuel cam for driving the unit injectors in a side-by-side relation to the intake and exhaust cam shafts.

When the unit injectors are driven by this fuel cam through rocker arms, i.e. fuel valve arms, the degree of the parallelism between the cam shaft and the fuel valve arm shaft is an important factor as is the case with the degree of parallelism between the cam shaft and the intake and exhaust valve arm shafts.

The intake and exhaust valve arm shafts, cam shaft and the fuel valve arm shaft may be supported by independent supporting means but such a way of supporting makes it quite difficult to obtain the desired degree of parallelism of these shafts and requires much labor and time undesirably. The supporting of these shafts by independent supporting means imposes also another problem that the distance between adjacent shafts is delicately changed during the operation of the engine to impair the durability.

On the other hand, in the engine in which the cam shaft is driven through a timing belt, it is necessary to dispose the timing belt at the outside of the engine to keep the timing belt away from the oil, while the cam shaft is mounted in the oil chamber in the engine. In such a case, therefore, it is necessary to employ an oil seal for the cam shaft.

SUMMARY OF THE INVENTION

Accordingly, it is a first object of the invention to ensure a high degree of parallelism of the shafts such as cam shaft, fuel valve arm shaft and intake and exhaust valve arm shafts.

It is a second object of the invention to realize a compact construction of the engine to thereby shorten the assembling time while reducing the number of steps of the assembling process.

It is a third object of the invention to apply various improvements to every part of the valve arm chamber apparatus to thereby attain a higher performance of the engine while facilitating the maintenance of the same.

To these ends, according to the invention, there is provided a valve arm chamber apparatus in which a cam shaft, fuel valve arm shaft, and intake and exhaust valve arm shafts, as well as the parts driven by these shafts, are mounted in a cover which is a member defining the valve arm chamber.

More specifically, according to an aspect of the invention, there is provided, in a diesel engine having a common cam shaft disposed above the intake and exhaust valves of the engine, the cam shaft carrying fuel cams for rocking fuel valve arms which drive unit injectors mounted in the cylinder head of the engine and intake and exhaust valve cams for rocking intake and exhaust valve arms for opening and closing the intake and exhaust valves of the engine, a valve arm chamber apparatus comprising a valve arm chamber which commonly accommodates the cam shaft, a fuel valve arm shaft for supporting the fuel valve arms, and intake and exhaust valve arm shafts for supporting the intake and exhaust valve arms.

According to another aspect of the invention, the cam shaft, the fuel valve arm shaft for supporting the fuel valve arms, and intake and exhaust valve arm shafts for supporting the intake and exhaust valve arms are carried by a common supporting member.

The valve arm chamber may have an inclined top surface having an opening therein, the opening being usually closed by a valve arm chamber lid. The cam shaft is positioned preferably above the level of an adjusting screw for the intake and exhaust valve arm and below the level of the rollers of the fuel valve arms. Unit injector retainers are disposed within the valve arm chamber in parallel with the axis of the cam shaft. A rotation prevention pin for preventing the rotation of a control rod which controls the rate or quantity of injection of fuel from the unit injectors mounted on the engine through the valve arm chamber, the chamber being composed of a valve arm chamber member provided with an integral rib serving as a stopper for preventing the rotation prevention pin from coming off.

DESCRIPTION OF THE PREFERRED EMBODIMENTS

Figure 2:
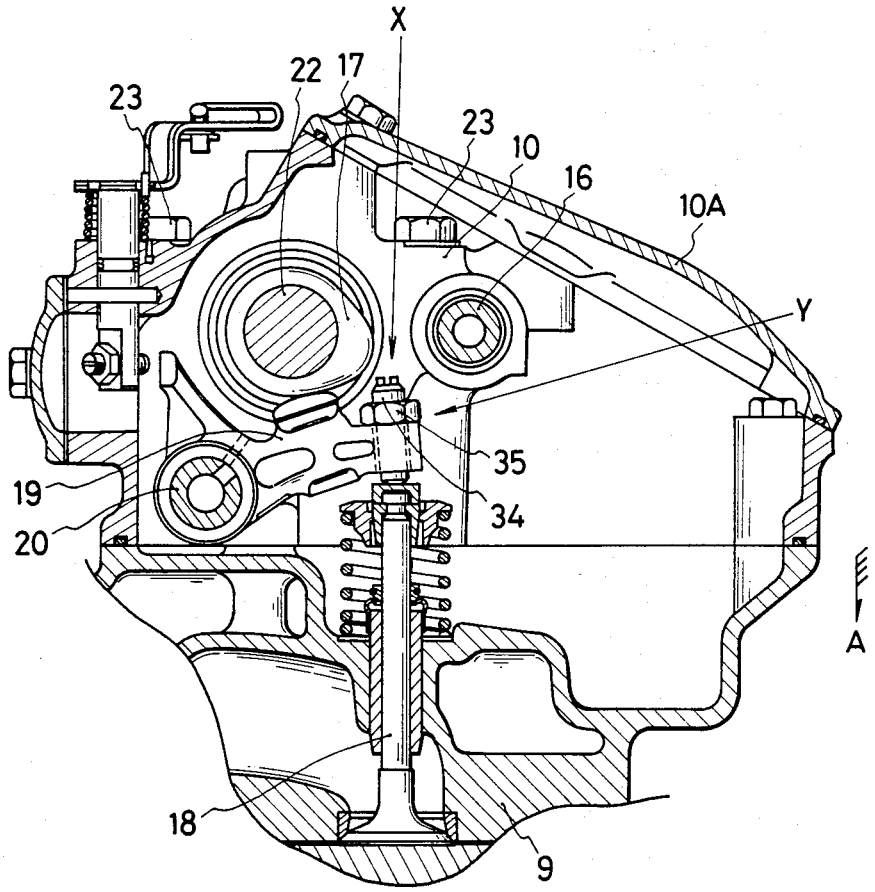
FIG. 2 is a sectional view taken along the line A—A of FIG. 1.
Figure 3:
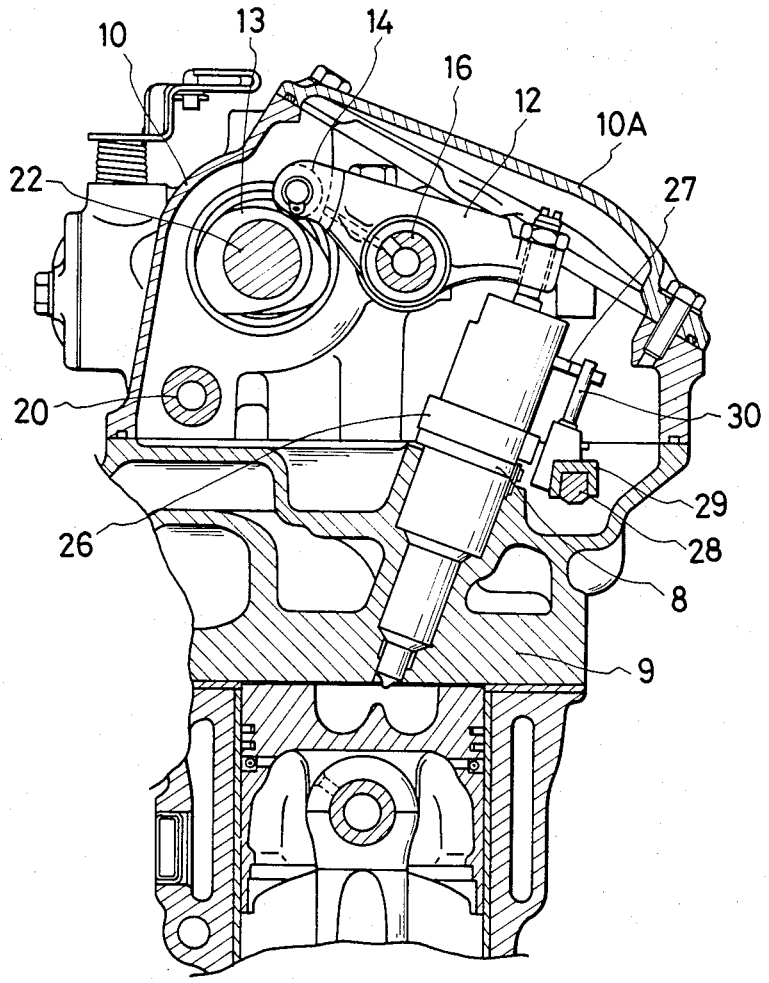
FIG. 3 is a sectional view taken along the line B—B of FIG. 1.

As shown in FIG. 3, a diesel engine has a cylinder head 9 in which mounted are unit injectors 8 (only one of them is shown) adapted to be actuated by fuel valve arms 12. The cylinder head 9 carries, as shown in FIG. 2, also intake and exhaust valves 18 (only one of them is shown) adapted to be actuated by valve arms 19. The fuel valve arms 12 and the intake and exhaust valve arms 19 are adapted to be driven by fuel cams 13 and intake and exhaust valve arm cams 17 which are mounted on a common cam shaft 22 disposed above the intake and exhaust valve arms 19 as shown in these Figures.

Figure 1:
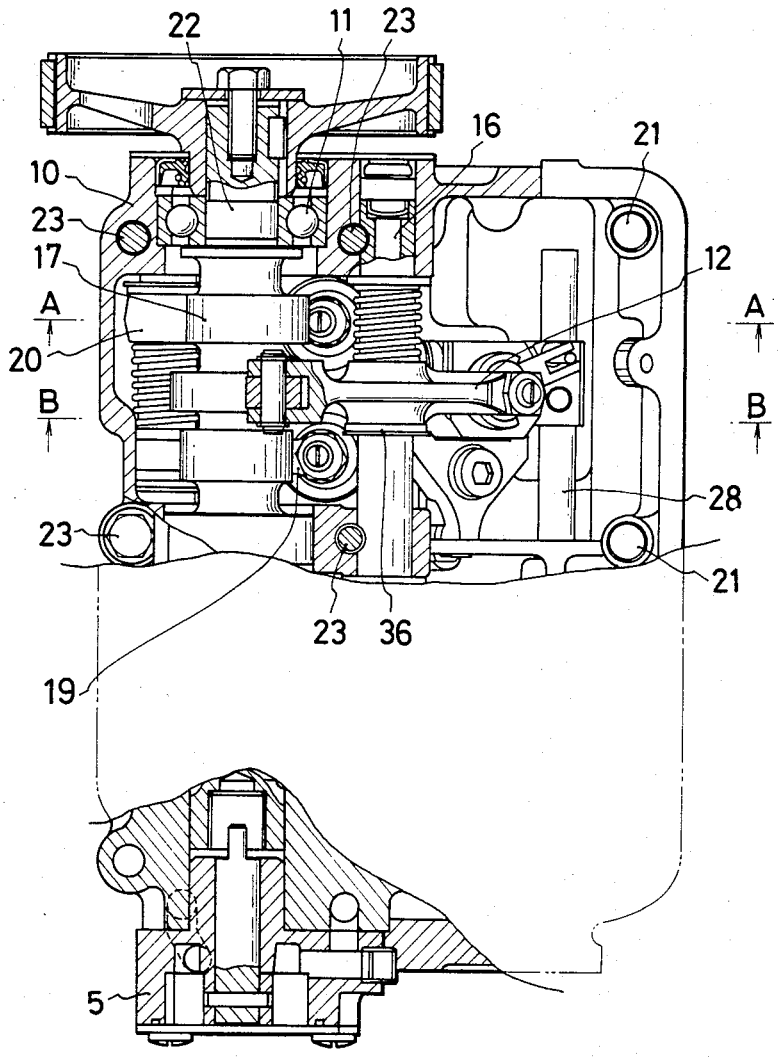
FIG. 1 is a partly-sectioned view of a diesel engine incorporating a valve arm chamber apparatus embodying the present invention as viewed from the upper side of the cylinder head of the engine.

As shown in FIG. 1, the fuel valve arms 12 and the intake and exhaust valve arms 19 are supported by a fuel valve arm shaft 16 and an intake and exhaust valve arm shaft 20, respectively. Referring again to FIG. 3, the cam shaft 22, the fuel valve arm shaft 16 and the intake and exhaust valve arm shaft 20 are mounted in a common valve arm chamber member 10 which is formed as an integral member. As shown in FIG. 1, the valve arm chamber member 10 is fixed to the cylinder head 9. More specifically, the portions of the valve arm chamber member 10 positioned at both sides of the cam shaft 22 are fastened by bolts 23, while both end portions of the valve arm chamber member 10 are fastened by means of bolts 21.

Although FIG. 1 shows only two bolts 23 which fasten the valve arm chamber member at both sides of the cam shaft 22 and the central portion thereof, a plurality of bolts 23 are used to fasten the portions around bearings 11 to hold the cam shaft 22 which receives the greatest force and to retain the fuel valve arm shaft 16 and the intake and exhaust valve arm shaft 20 to prevent the rotation.

In the valve arm chamber apparatus of this embodiment having the described construction, the cam shaft 22, intake and exhaust valve arm shaft 20 and the fuel valve arm shaft 16 are preset in the valve arm chamber member 10, and this assembly is mounted as a unit in the cylinder head 9.

This arrangement permits an easy mounting of the valve arm chamber and the associated parts, as well as a compact construction of the structure in the cylinder head of the engine.

Referring again to FIG. 1, a lubricating oil pump 5 is connected to the end of the cam shaft 22. This lubricating oil pump 5, as well as other members, is also preset in the valve arm chamber member 10 before the latter is mounted in the cylinder head 9.

Consequently, in the diesel engine to which the valve arm chamber apparatus of the invention is applied, it is possible to realize a compact construction of the engine as a whole. In addition, the cam shaft 22, fuel valve arm shaft 16, intake and exhaust valve arm shaft 20, as well as parts driven by these shafts or associated therewith, can be assembled quite easily and efficiently because these shafts and parts can be preset in the valve arm chamber member 10 and can be mounted in the cylinder head 9 as a unit with the latter when the latter is mounted in the cylinder head 9.

In addition, the unitary and preset construction of the valve arm chamber apparatus affords a sufficiently high degree of parallelism of the shafts in relation to one another and reduces the number of steps of the process for mounting these shafts on the engine.

It is also to be noted that, in the described embodiment of the invention, the top surface of the valve arm chamber member 10 accommodating the fuel valve arms 12, intake and exhaust valve arms 19, cam shaft 22 and a control rod 28 (see FIGS. 3 and 5) is cut obliquely. Namely, the top surface of the valve arm chamber member 10 has an opening which is in a plane substantially perpendicular to the direction of mounting and demounting of unit injectors 8 which are carried by the cylinder head 9 at an inclination. This opening has a substantial area and is closed by a valve arm chamber lid 10A having a correspondingly large size.

In the described embodiment, since the top surface of the valve arm chamber member 10 is declined to have an inclined large top opening covered by the valve arm chamber lid 10A, it is possible to rotate an adjusting screw 34 for adjusting the clearance between the head of the intake or exhaust valve 18 and the arm 19 for actuating the same, by means of a screw driver which may be inserted from the outside of the valve arm chamber member 10 through a gap between the fuel valve arm shaft 16 and the cam shaft 22 as indicated by an arrow X, although the adjusting screw 34 is located at a position below the cam shaft 22 and, hence, difficult to approach. It is also possible to lock the adjusting screw 34 by a lock nut 35 by means of a wrench or a like tool which may be inserted in the direction of arrow Y through a gap formed beneath the fuel valve arm shaft 16.

In addition, by demounting the valve arm chamber lid 10A closing the top opening of the valve arm chamber member 10, the unit injectors 8 can be mounted and demounted on and from the cylinder head 9 in quite an easy manner. In addition, it is easy to make an access to the portion requiring a fine adjustment in the connection between the fork member of a lever 27 for controlling the fuel injection quantity of the unit injector 9 and a pin 30 of an adjuster 29 secured to the control rod 28. Furthermore, by removing the valve arm chamber lid 10A, it is possible to effect quite easily various adjustment and locking operations such as the adjustment and locking of the valve rod clearance between the intake or the exhaust valve 18 and the valve arm 19, fine adjustment of the connection between the control rod 28 for controlling the fuel injection quantity and the adjuster 29, and so forth.

The cam shaft 22 disposed in the valve arm chamber member 10 is positioned above the adjusting screw 34 of the intake and exhaust valve arm 19 and below the roller 14 of the fuel valve arm 12 for driving each fuel injector 8. It is, therefore, easy to rotate the adjusting screw 34 and to lock the same by the lock nut 35 after adjustment, while realizing a compact arrangement in the valve arm chamber.

The invention will be further described with reference to FIG. 4 which is a partly cut-away plan view of an essential part of the valve arm chamber and FIG. 5 which is a sectional view taken along the line C—C of FIG. 4, as well as to FIG. 3.

Figure 4:
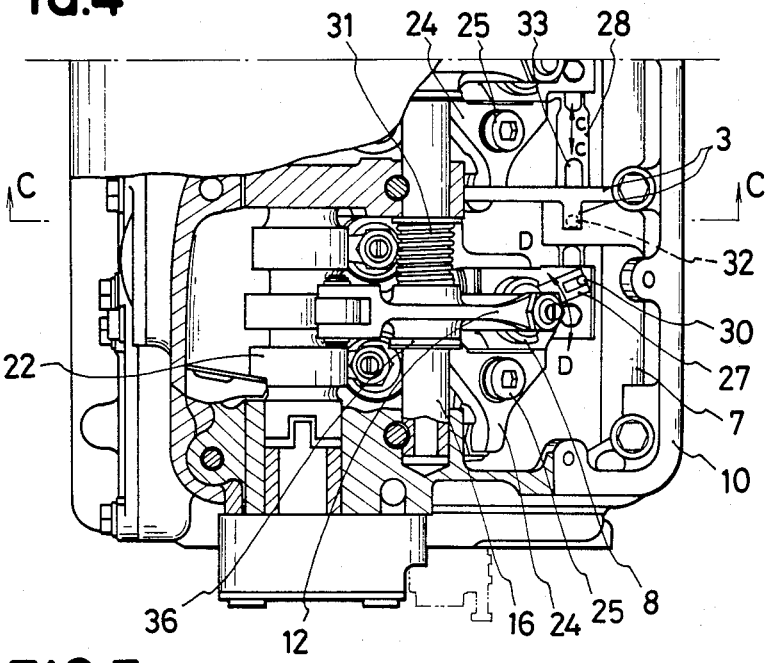
FIG. 4 is a side elevational view of an essential part of a valve arm chamber as shown in FIG. 1.
Figure 5:
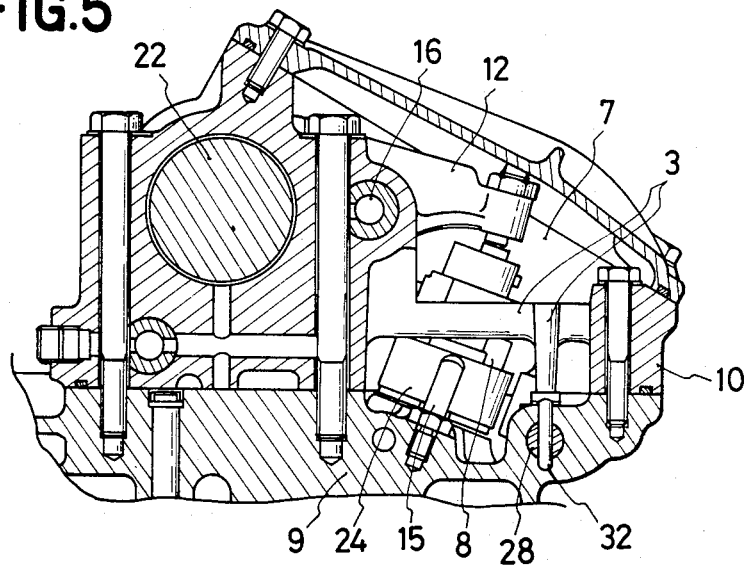
FIG. 5 is a sectional view taken along the line C—C of FIG. 4.

As will be seen from FIG. 4, a unit injector retainer 24 for fixing the unit injector 8 in the valve arm chamber member 10 to the cylinder head 9 is disposed in parallel with the axis of the cam shaft 22. The unit injector retainer 24 is adapted to be fastened to the cylinder head 9 by means of a bolt 25. Namely, the unit injector retainer 24 is a bifurcated member having a crotch part 26 in which the unit injector 8 is held. As will be seen from FIG. 5, there is provided a seat 15 for the unit injector retainer 24. The position at which the unit injector retainer 24 retains the unit injector on the cylinder head and the positions of the bolt 25 and the seat 15 are arranged in parallel to the cam shaft 22, fuel valve arm shaft 16, intake and exhaust valve arm shaft 20 and the control rod 28.

The fuel valve arm 12 is urged at its one end by a spring 31 and is stopped by a stopper ring 36 at its other end. As the stopper ring 36 is detached, the fuel valve arm 12 becomes able to move in the direction in which it is urged by the spring 31. Then, by removing the bolt 25 fastening the unit injector retainer 24, it is possible to extract the unit injector 8 as a unit without substantial difficulty.

Since the unit injector retainer 24 extends parallel with the cam shaft 22 and other shafts, it can be detached without being interfered by the control rod 28 and the fuel valve arm shaft 16, so that the disassembling of the unit injector 8, as well as the maintenance and inspection of the same, is facilitated advantageously.

Furthermore, in the apparatus of the invention, the lever 27 is rotated in the directions of arrows D-D in response to a linear movement of the control rod 28 in the directions of arrow C-C, as shown in FIG. 4, thereby to effect an adjustment of the quantity of fuel injection from the unit injector 8. In order to prevent the control rod 28 from rotating undesirably, a rotation prevention pin 32 as shown in FIG. 5 is driven into the cylinder head 9 through an elongated hole 33 formed in the control rod 28 as shown in FIG. 4.

The rotation prevention pin 32 is retained at its head portion by a rib 3 which is integrally formed on the valve arm chamber member 10. Since this rib 3 serves as a retainer for preventing the rotation prevention pin 32 from coming off, the rotation prevention pin 32 becomes easily withdrawable as the valve arm chamber member 10 is demounted, so that the disassembling and inspection of the engine is very much facilitated.

This rib 3 serves also to connect the bosses in the valve arm chamber member 10 for supporting the cam shaft 22, fuel valve arm shaft 16 and so forth to the peripheral portion of the valve arm chamber 7 thereby to increase the rigidity of the valve arm chamber member 10. Furthermore, the provision of the rib facilitates the fabrication of the valve arm chamber member 10 by casting because this rib 3 can be utilized as a part of the runner for molten metal during the casting.

It is also to be noted that diesel engine incorporating the valve arm chamber apparatus of the invention can have a compact construction because the cam shaft 22, fuel valve arm shaft 16 and other associated members are assembled together as a unit with the valve arm chamber member 10.

In addition, for the same reason, the mounting of the valve arm chamber apparatus is facilitated and the cost for the mounting is decreased advantageously.

Furthermore, it is possible to attain sufficiently high dimensional precision such as the degree of parallelism of the cam shaft 22, fuel valve arm shaft 15 and the intake and exhaust valve arm shaft 20 in relation to one another, and to maintain the required degree of parallelism even if there is a slight play in the supporting members.

Furthermore, according to the invention, it is possible to attain improvements in the function and performance of the diesel engine by effecting various modifications to parts and elements of the valve arm chamber apparatus described hereinbefore.

What is claimed is:

1. In a diesel engine having a common cam shaft disposed above the intake and exhaust valves of said engine, said cam shaft carrying fuel cams for rocking fuel valve arms which drive unit injectors mounted in the cylinder head of said engine and intake and exhaust valve cams for rocking intake and exhaust valve arms for opening and closing said intake and exhaust valves of said engine, a valve arm chamber apparatus for diesel engines comprising a valve arm chamber member which supports said cam shaft and a fuel valve arm shaft for supporting said fuel valve arms and intake and exhaust valve arm shafts for supporting said intake and exhaust valve arms, said valve arm chamber being detachably mounted as a unit assembly with said shafts on said cylinder head.

2. In a diesel engine having a common cam shaft disposed above the intake and exhaust valves of said engine, said cam shaft carrying fuel cams for rocking fuel valve arms which drive unit injectors mounted in the cylinder head of said engine and intake and exhaust valve cams for rocking intake and exhaust valve arms for opening and closing said intake and exhaust valves of said engine, a valve arm chamber apparatus for diesel engines comprising a common supporting member which supports said cam shaft and a fuel valve arm shaft for supporting said fuel valve arms and intake and exhaust valve arm shafts for supporting said intake and exhaust valve arms, said common supporting member being detachably mounted as a unit assembly with said shafts on said cylinder head.

3. A valve arm chamber apparatus for diesel engines according to claim 1 or 2, wherein the valve arm chamber has an inclined top surface having an opening therein, said opening being usually closed by a valve arm chamber lid.

4. A valve arm chamber apparatus for diesel engines according to claim 1 or 2, wherein said cam shaft is positioned above the level of an adjusting screw for said intake and exhaust valve arms and below the level of rollers of said fuel valve arms.

5. A valve arm chamber apparatus for diesel engines according to claim 1 or 2, wherein unit injector retainers are disposed within a valve arm chamber in a row parallel with a longitudinal axis of said cam shaft.

6. A valve arm chamber apparatus for diesel engines according to claim 1 or 2, characterized by comprising a rotation prevention pin for preventing the rotation of a control rod which controls the quantity of injection of fuel from said unit injectors mounted on said engine, said valve arm chamber further comprising an integral rib provided therein serving as a stopper for preventing said rotation prevention pin from coming off.

* * * * *